US005123266A

United States Patent [19]

Tabraham

[11] Patent Number: 5,123,266

[45] Date of Patent: Jun. 23, 1992

[54] WALL MOUNTED CLOTHES STEAMER WITH HOSE AND NOZZLE

[76] Inventor: David Tabraham, P.O. Box 16470, Vlaeberg, 8018, Cape Town, South Africa

[21] Appl. No.: 624,871

[22] Filed: Dec. 5, 1990

[30] Foreign Application Priority Data

Dec. 5, 1989 [ZA] South Africa ..... 89/9281

[51] Int. Cl.[5] ..... D06F 71/34; D06F 75/16

[52] U.S. Cl. ..... 68/222; 392/379; 392/392; 38/14; 38/77.8; 223/51; D32/17

[58] Field of Search ..... 38/1 R, 1 A, 3, 14, 38/15, 69, 74, 77.6, 77.8, 77.83, 137; 223/51; 68/5 R, 5 A, 5 B, 222; 392/324, 392, 404, 405, 381, 379, 399, 313, 316, 320, 333, 363, 394, 397, 406, 441, 484; D32/17

[56] References Cited

U.S. PATENT DOCUMENTS

| | | | |
|---|---|---|---|
| 2,787,900 | 4/1957 | Chrisman | 68/5 B |
| 3,436,852 | 4/1969 | Stansbury | 392/405 X |
| 3,449,838 | 6/1989 | Chancellor | 392/381 X |
| 3,550,285 | 12/1970 | Omohundro | 392/404 |
| 3,559,427 | 2/1971 | Baker | 68/222 |
| 3,581,529 | 6/1971 | Mitchell | 68/222 |
| 3,793,753 | 2/1974 | Engelbart | 392/404 X |
| 3,892,945 | 7/1975 | Lerner | 392/405 X |
| 3,997,759 | 12/1976 | Osrow et al. | 68/222 X |
| 4,700,049 | 10/1987 | Rubin | 392/381 |
| 4,896,396 | 7/1990 | Giannelli | 68/222 X |

FOREIGN PATENT DOCUMENTS

| | | | |
|---|---|---|---|
| 0079866 | 5/1983 | European Pat. Off. | 38/14 |
| 0282880 | 11/1934 | Italy | 392/381 |

*Primary Examiner*—Werner H. Schroeder
*Assistant Examiner*—Ismael Izaguirre
*Attorney, Agent, or Firm*—Rockey and Rifkin

[57] ABSTRACT

A clothes steamer which can be secured to a wall such as the wall of a hotel room, the steamer including a housing with a heating element in it. The element boils water which is in the housing and causes a flow of steam along a flexible hose to a nozzle. An audible warning device is provided for indicating that an adequate supply of steam is being generated.

9 Claims, 3 Drawing Sheets

WALL MOUNTED CLOTHES STEAMER WITH HOSE AND NOZZLE

CROSS REFERENCE TO THE RELATED APPLICATION

This application claims the benefit of the priority date of co-pending South African Patent Application Ser. No. 89/9281, filed on Dec. 5, 1989 in the Republic of South Africa.

BACKGROUND OF THE INVENTION

1. Field of the Invention

This invention relates to a device for removing wrinkles and creases from clothes by applying steam thereto. In particular, this invention relates to a clothes steamer which can be secured or mounted on a vertical surface.

2. Description of the Related Art

With increasing labor costs establishments such as hotels, apart from luxury hotels, are continually seeking ways of providing guests with the services they require in the least labor intensive manner. As a result, apparatus such as coffee and tea making machines, mini-bars, clothes drying lines and hairdryers have all made their appearance in hotel rooms. An area which, to applicant's knowledge, has not yet received attention is that of clothes pressing. Travellers, particularly business travellers, can well be faced with the problem of crumpled suits. If the hotel does not provide a valet service then the guest is faced with either finding an outside dry-cleaning and pressing service or perhaps simply hanging the clothes in a steam filled bathroom in an effort to remove the creases.

SUMMARY OF THE INVENTION

An object of the invention is to provide a clothes steamer and in particular a clothes steamer suitable for the use of hotel guests.

A further object of the present invention is to provide a clothes steamer which is safe to use and which cannot readily be removed from the vertical surface on which it is mounted.

According to the present invention there is provided a clothes steamer comprising a housing including means for mounting the housing on a vertical surface, a closable filler opening through which water can be poured into the housing, an electrical heating element in the lower part of said housing, and a flexible hose one end of which is in communication with the interior of said housing whereby steam generated in the housing enters said hose, there being a nozzle at the other end of the hose through which steam generated in said housing emerges.

A steam operated audible warning device can be provided and said housing can be formed with means for supporting said nozzle in an inoperative position, a mouth of the nozzle coming into register with a flowpath leading to said device as said nozzle is placed on the supporting means.

Said means for supporting said nozzle preferably comprises a recess in said housing, said flowpath leading from said recess to said device and in which said nozzle is elongate in form and comprises a portion which can be gripped for use, a connection at one end to which said hose is secured and a mouth at the other end through which steam emerges, the part of the nozzle including said mouth being in said recess when the nozzle is in its inoperative position.

Said portion of the nozzle can be double walled thereby to provide a central steam passage surrounded by an outer wall, there being an insulating air gap between said outer wall and said passage.

To enable the current to said element to be controlled a rheostat can be provided and a thermostat can be provided for interrupting the electrical supply to said element in the event that the housing has insufficient water therein.

In one form the clothes steamer includes a pipe within said housing, one end of said pipe opening into the upper end of the housing and the other end being in communication with said hose which emerges from said housing near the lower end thereof. In another form said hose communicates with the interior of the housing through an opening in the top wall thereof.

BRIEF DESCRIPTION OF THE DRAWINGS

For a better understanding of the present invention, and to show how the same may be carried into effect, reference will now be made, by way of example, to the accompanying drawings in which.

DESCRIPTION OF THE PREFERRED EMBODIMENTS

Figure 3:
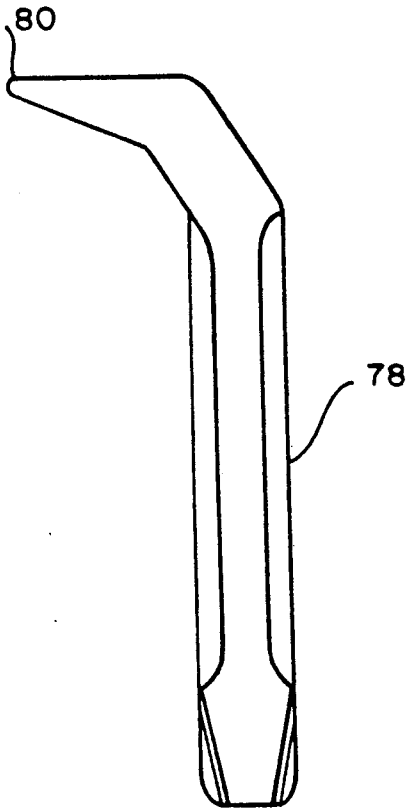
FIG. 3 is a side elevation of a steam nozzle.
Figure 1:
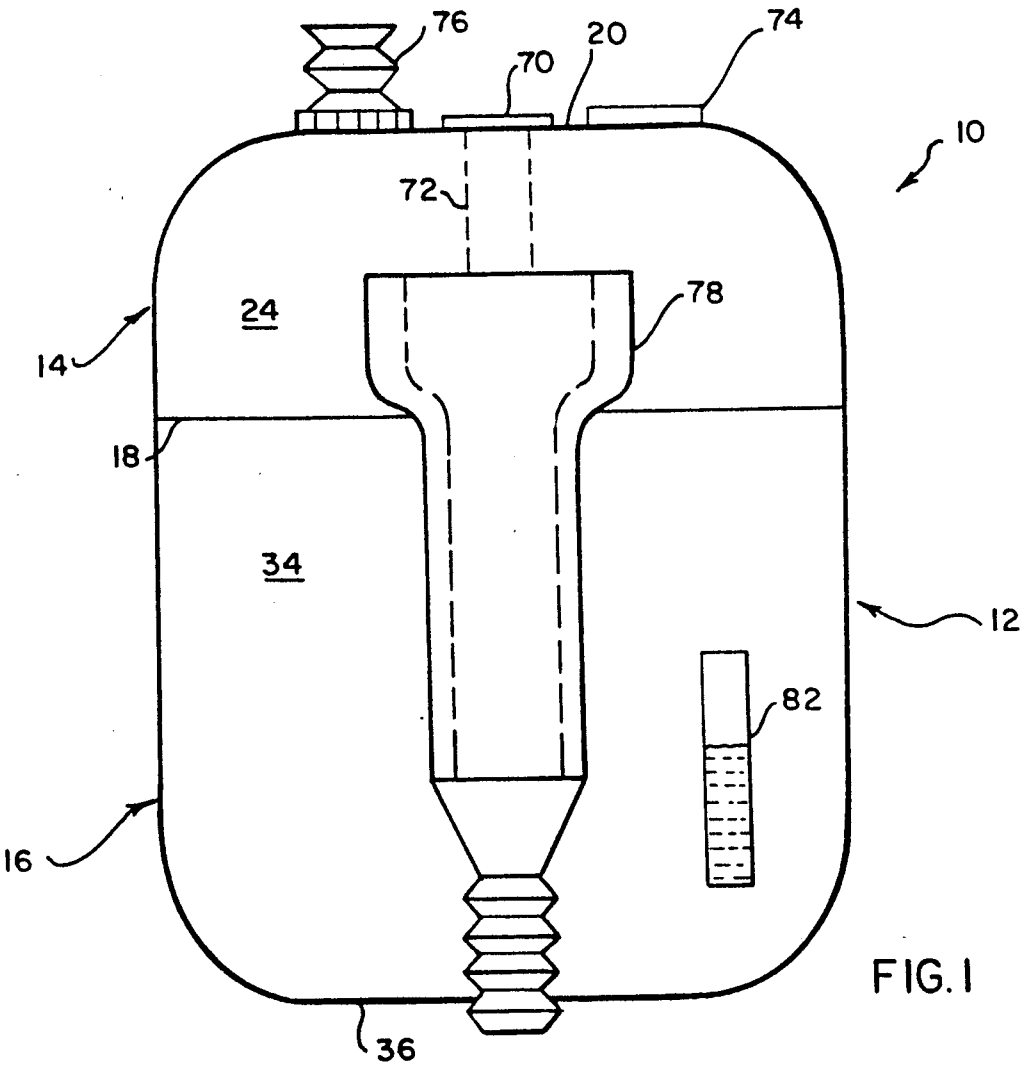
FIG. 1 is a front elevation of a clothes steamer in accordance with the present invention.
Figure 2:
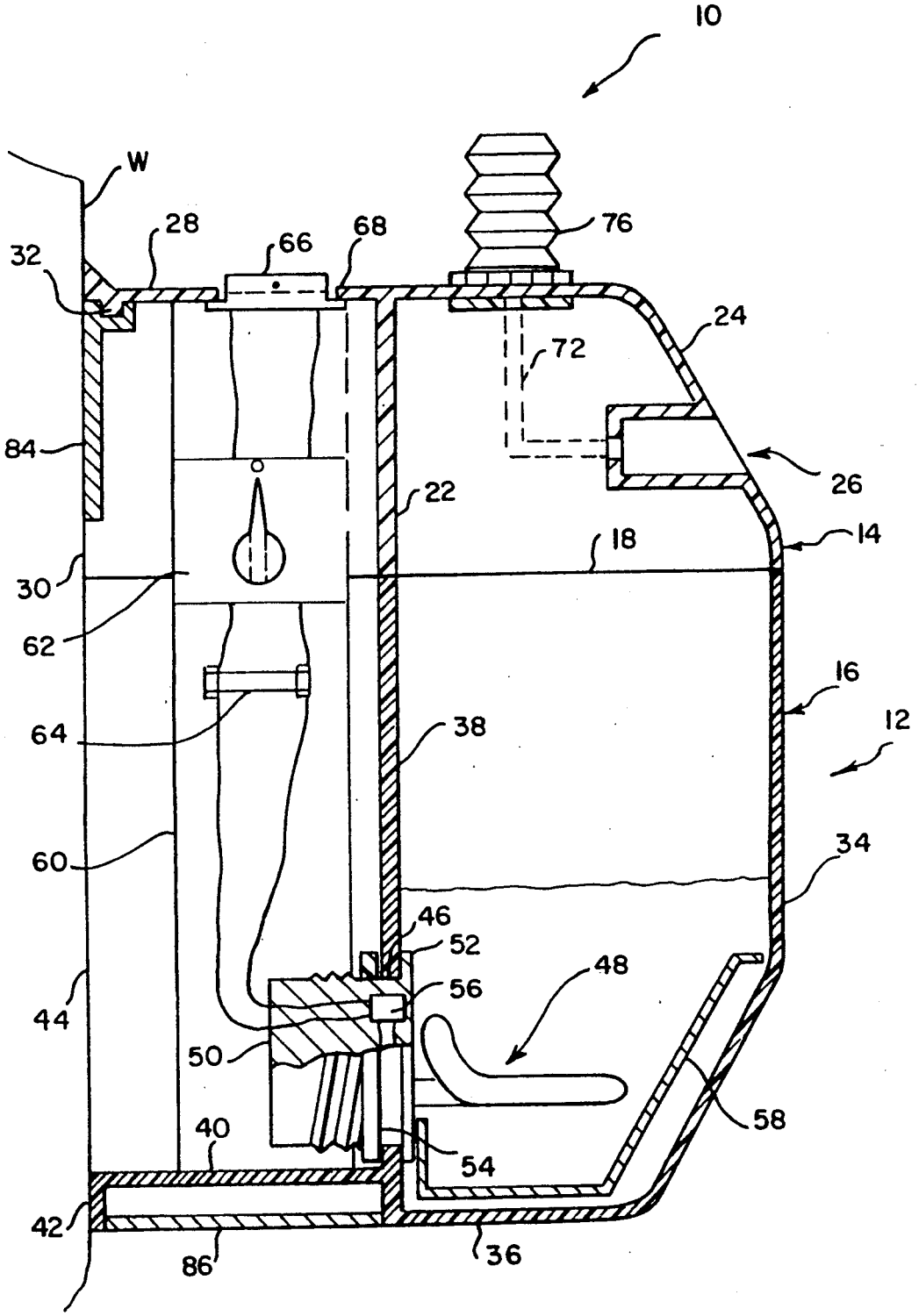
FIG. 2 is a vertical section through the clothes steamer of FIG. 1.

The clothes steamer 10 illustrated in FIGS. 1, 2 and 3 comprises a housing 12 consisting an upper part 14 and a lower part 16 which are secured to one another along a horizontal joint 18.

The upper housing part 14 comprises a top wall 20, a rear wall 22, a front wall 24 with a recess 26 therein, a rearward extension 28 of the top wall 20 and side walls 30 depending from the rearward extension 28. There is a transversely extending rib 32 on the underside of the rearward extension 28.

The lower housing part 16 comprises a front wall 34, a bottom wall 36, a rear wall 38, and a rearward extension 40 at the free end of which there is a depending flange 42. Side walls 44 extend upwardly from the extension 40. An opening 46 is formed in the rear wall 38 and a heating element 48 is mounted in this opening.

The housing parts can be attached to one another by screws (not shown) passing through bosses (not shown) on the inner faces of the parts. A seal can be interposed between the parts 14 and 16.

The heating element 48 includes a body 50 which is pushed, from right to left as illustrated in FIG. 2, into the opening 46 until a flange 52 of the body encounters the wall 38. A nut 54 is then screwed onto the body to clamp the element 48 in place. Sealing gaskets (not shown) are provided on each side of the wall 38. A thermostat 56 is built into the upper part of the body 50. A metal plate 58 forms a heat barrier between the element 48 and the bottom wall 36 and the lower part of the front wall 34.

Between the rearward extensions 28 and 40 there is an electrical mounting board 60 which carries a rheostat 62 and a fuse 64. A switch 66 is mounted in an opening 68 in the rearward extension 28. The board 60 is mounted on the inner faces of one of the side walls 30, 44. The electrical components are all shown diagrammatically.

A whistle 70 (FIG. 1) is mounted in an opening provided therefor in the top wall 20. A pipe 72 leads from an opening in the rear wall of the recess 26 to the whistle. Reference numeral 74 in FIG. 1 generally designates a plug which is pushed into a filler opening provided in the top wall 20. The opening is normally closed by the plug 74 except when the water level in the housing is to be topped-up.

A flexible hose 76 extends upwardly from an opening provided in the top wall 20 of the upper housing part 14.

A nozzle 78 (shown in FIGS. 1 and 3 but not in FIG. 2) is attached to that end of the hose 76 which is remote from the opening in the top wall 20. The tip 80 of the nozzle is configured so that it can enter the recess 26 whereby the nozzle is supported by the housing 12 when not in use. The nozzle 78 is double walled, the space between the walls forming an air gap so that the outer wall of the nozzle does not become too hot to grip.

The inner wall of the double wall is shown by the dotted lines in FIG. 1, and forms a central steam passage.

A sight glass 82 is mounted on the front wall 34 of the lower housing part 16 and is marked to show the degree to which the housing has been filled with water.

To mount the clothes steamer on a wall W, a bracket 84 (FIG. 2) is secured to the wall by suitable fastening elements (not shown) passed through the bracket and into the wall. The bracket has a groove in the top face thereof into which the rib 32 is pressed. The housing 12 is then swung down so that the flange 42 contacts the wall W and is secured thereto by further fastening elements. A cover plate 86 is snapped into place to conceal the fastening elements.

To provide steam, water is poured into the housing through the filler opening until the maximum level indicated by the sight glass 82 is reached. The clothes steamer is then switched on by means of the switch 66. The space above the water in the lower housing part eventually fills with steam which passes through the hose 76 to the nozzle 78. Whilst the tip 80 of the nozzle 78 is in the recess 26, steam emerging from the nozzle passes along the flowpath constituted by the pipe 72 and through the whistle 70. As soon as the rate of generation of steam is adequate, the whistle sounds and this indicates to the person who is desirous of steaming clothes that the clothes steamer is now ready for use. The nozzle 78 is then lifted away from the housing 12, this automatically stopping the whistle, and the tip 80 of the nozzle is directed at the clothing.

If the clothes steamer is not switched off using the switch 66 before the water level in the housing drops sufficiently to expose the upper part of the element 48, the thermostat 56 automatically switches the element off. On cooling, the thermostat resets itself but will thereafter open again unless further water is poured into the housing.

The rheostat 62 controls the rate at which the water boils. The rate of boiling is restricted so that water is not expelled from the housing and into the hose 76.

Figure 4:
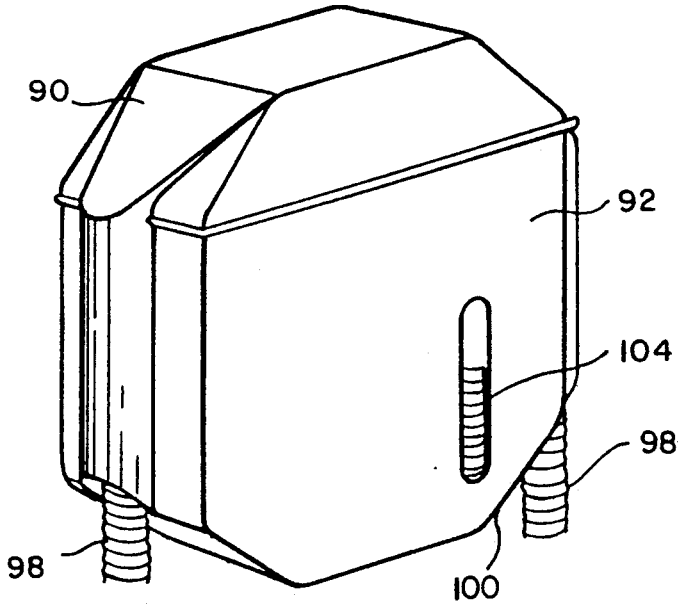
FIG. 4 is a pictorial view of a further clothes steamer.
Figure 7:
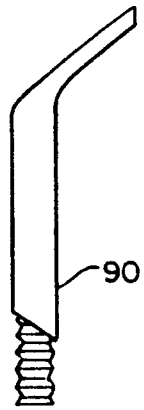
FIG. 7 is a side elevation of the nozzle of the steamer of FIGS. 4 to 6.
Figure 6:
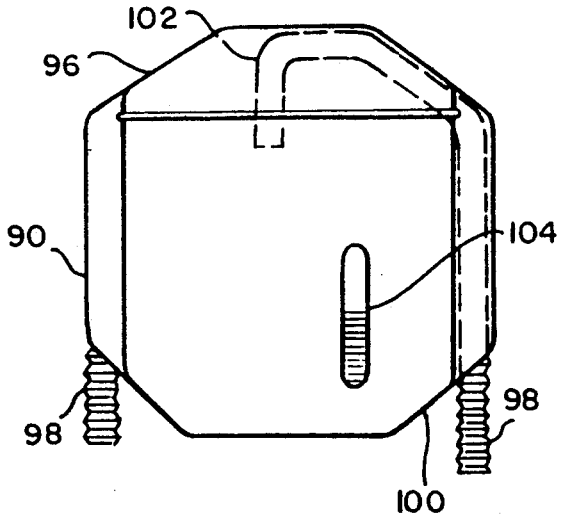
FIG. 6 is an elevation of the clothes steamer of FIGS. 4 and 5.
Figure 5:
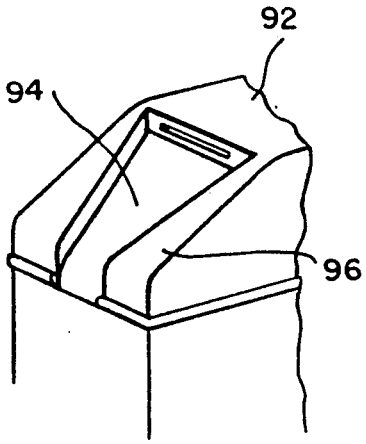
FIG. 5 illustrates an upper corner of the housing of the clothes steamer of FIG. 4, the nozzle not being shown in FIG. 5.

The clothes steamer of FIG. 4 differs from that of FIGS. 1 to 3 only insofar as the arrangement of the nozzle, designated 90, with respect to the housing, designated 92 is concerned. In the embodiment of FIGS. 4, 5 and 6, the nozzle 90 is received in a recess 94 which is in an inclined side face 96 of the housing 92. The hose, designated 98, emerges from the lower end of the nozzle 90 and re-enters the housing 92 through an inclined downwardly directed face 100 thereof. Thus the hose 98 hangs in a loop. A pipe 102 (see FIG. 6) of inverted U-configuration forms a steam path from the upper part of the housing 92 to the point where the hose 98 enters the housing through the face 100. A sight glass is shown at 104.

I claim:

1. A clothes steamer comprising a housing including means for mounting the housing on a vertical surface, a closable filler opening through which the housing is filled with water, an electrical heating element in a lower part of said housing, and a flexible hose one end of which is in communication with the interior of said housing whereby steam generated in the housing enters said hose, there being a nozzle at the other end of the hose through which steam generated in said housing emerges.

2. A clothes steamer according to claim 1, wherein a steam operated audible warning device is provided and said housing is formed with means for supporting said nozzle in an inoperative position, a mouth of the nozzle coming into register with a flowpath leading to said device as said nozzle is placed on the supporting means.

3. A clothes steamer according to claim 2, wherein said means for supporting said nozzle comprises a recess in said housing, said flowpath leading from said recess to said device and in which said nozzle is elongate in form and comprises a portion which is gripped for use, a connection at one end to which said hose is secured and a mouth at the other end through which steam emerges, the part of the nozzle including said mouth being in said recess when the nozzle is in said inoperative position.

4. A clothes steamer according to claim 3, wherein said portion of the nozzle is double walled thereby to provide a central steam passage surrounded by an outer wall, there being an insulating air gap between said outer wall and said passage.

5. A clothes steamer according to claim 1, and including a rheostat for controlling the current to said element and a thermostat for interrupting the electrical supply to said element in the event that the housing has insufficient water therein.

6. A clothes steamer according to claim 1, and including a pipe within said housing, one end of said pipe opening into the upper end of the housing and the other end being in communication with said hose which emerges from said housing near the lower end thereof.

7. A clothes steamer according to claim 1, wherein said hose communicates with the interior of the housing through an opening in the top wall thereof.

8. A clothes steamer according to claim 1, and including a sight glass which visually indicates the water level in the housing.

9. A clothes steamer according to claim 1 and a mounting bracket therefor, the housing including a rib at the upper end thereof for engaging in an upwardly open groove of the bracket, and a mounting flange at the lower end thereof through which fixing elements are passed to secure said mounting flange to a wall.

* * * * *